US005968689A

United States Patent [19]

Torikoshi et al.

[11] Patent Number: 5,968,689

[45] Date of Patent: Oct. 19, 1999

[54] IMAGE-FORMING MATERIAL, PROCESS FOR PREPARATION THEREOF, AND IMAGE-RECEIVING MEDIUM

[75] Inventors: Kaoru Torikoshi; Isamu Suzuki; Hirotaka Matsuoka, all of Minami-Ashigara, Japan

[73] Assignee: Fuji Xerox Co., Ltd., Tokyo, Japan

[21] Appl. No.: 08/884,849

[22] Filed: Jun. 30, 1997

[30] Foreign Application Priority Data

Jul. 4, 1996 [JP] Japan ..... 8-175258

[51] Int. Cl.[6] ..... G03G 9/097; G03G 13/08; G03C 3/00

[52] U.S. Cl. ..... 430/18; 430/110; 430/111; 430/97; 430/120; 430/137

[58] Field of Search ..... 430/18, 110, 111, 430/97, 120, 137

[56] References Cited

U.S. PATENT DOCUMENTS

| | | | |
|---|---|---|---|
| 5,135,833 | 8/1992 | Matsunaga et al. | 430/110 |
| 5,459,008 | 10/1995 | Chambers et al. | 430/47 |
| 5,480,759 | 1/1996 | Kasuya et al. | 430/111 |
| 5,753,399 | 5/1998 | Hayase et al. | 430/110 |

FOREIGN PATENT DOCUMENTS

| | | |
|---|---|---|
| 36-10231 | 7/1936 | Japan . |
| 58-215659 | 12/1983 | Japan . |
| 60-217366 | 10/1985 | Japan . |
| 61-28688 | 7/1986 | Japan . |
| 1-101576 | 4/1989 | Japan . |
| 1-101577 | 4/1989 | Japan . |
| 1-297294 | 11/1989 | Japan . |
| 4-67043 | 3/1992 | Japan . |
| 4-300395 | 10/1992 | Japan . |
| 6-208318 | 7/1994 | Japan . |
| 6-219068 | 8/1994 | Japan . |
| 6-250569 | 9/1994 | Japan . |
| 6-250570 | 9/1994 | Japan . |

*Primary Examiner*—Roland Martin
*Attorney, Agent, or Firm*—Oliff & Berridge, PLC

[57] ABSTRACT

The present invention provides an image-forming material which can be removed easily from image-receiving paper while maintaining the fixability to the image-receiving paper; a preparation process thereof, and the image-receiving medium. The image-forming material according to the present invention can be prepared by dispersing an oil phase, which contains an organic solvent, a binding resin, and a releasing agent composed of a hydrophobic resin and/or a wax, in an aqueous phase as oil droplets; removing the solvent from the dispersion; and incorporating the releasing agent by separating the residue from the aqueous phase. The image-forming material according to the present invention contains at least a binding resin and the above-described releasing agent and the releasing agent is contained in an amount of 30 to 90 wt % in solid content.

20 Claims, No Drawings

IMAGE-FORMING MATERIAL, PROCESS FOR PREPARATION THEREOF, AND IMAGE-RECEIVING MEDIUM

BACKGROUND OF THE INVENTION

1. Field of the Invention

This invention relates to an image-forming material used for an image-forming apparatus employing an electrophotographic system or thermal transfer system, a process for preparation of the material, and an image-receiving medium formed by the material. More specifically, the present invention pertains to an image-forming material which permits the repetition of image formation and image removal by using an apparatus for removing the image-forming material maintained on a base material or an image-forming apparatus equipped with a removal apparatus; a preparation process thereof and an image-receiving medium formed by the material.

2. Description of the Related Art

The awareness of the importance of protecting forest resources has grown recently with recognition of global environmental problems and the reduced use of wood resources as the raw material for manufacturing paper. One of the measures being promoted to reduce the amount of wood sources used is the recycling of used paper rather than disposing of it as ordinary garbage. The recycling of waste paper is an important method for recovering resources, but it involves a number of problems in the process from waste paper to recycled. The collection of waste paper, for example, is accompanied by problems such as the unwanted leakage of information from confidential documents or data particularly at business enterprises, the labor involved in collecting or transporting waste paper classified by type, the site where collected waste paper is accumulated, and how to manage such a site. Moreover, in the recycling of waste paper, waste paper pulping shortens pulp fibers, thereby deteriorating the quality of the recycled paper or it becomes necessary to add an apparatus to deink image portions. Furthermore, paper manufacturing equipment itself is so large, complicated, and expensive that it is not possible to deal with the recycling of waste paper individually and it becomes inevitable to turn to specialized enterprises. If such collection classified by paper type, transport, accumulation, and the operation of huge equipment are not done efficiently, the recycling of waste paper consumes much energy (leading to an increase in the amount of $CO_2$ emission), which may accelerate the greenhouse effects caused by increased amounts of $CO_2$, which has become a global environmental problem.

In order to solve such problems, a process to erase images from paper after use, followed by recycling, is disclosed. There are generally two methods for erasing images. One is to reduce the adhesion between an image-forming material and a base material (paper) by using a releasing liquid in which water or a solvent and a surfactant have been mixed, and apply heat or pressure, thereby wet-releasing the image-forming material from the base material. The other method is to release the image-forming material by applying an external force such as heat, pressure, or mechanical force without using water or a solvent, or to dry-release the image-forming material from the base material by applying heat, pressure, or mechanical force after forming an image under reduced adhesion in advance. The conventional process will hereinafter be described using examples.

Examples of the process using a releasing liquid composed of water and a surfactant include those disclosed in Japanese Patent Applications Laid-Open (JP-A) Nos. 6-250569, 6-208318, and 6-250570, wherein heat is applied to an image-receiving medium with an aqueous solution of a surfactant being retained on the medium, ink on the image-receiving medium is thermally fused, and ink is peeled away using a releasing means. In the above methods, however, the wettability between the image-retaining medium and the aqueous solution is important and the penetration of the aqueous solution into the boundary between the thermally fused ink and the image-retaining medium becomes necessary. When paper has solid-printed images on both sides, the aqueous solution does not penetrate into the boundary because it is repelled on the surface of the image-retaining medium, preventing the improving of releasability between the image-forming material and the image-retaining medium. The same can be applied to a case in which an image is released from an OHP transparency. When regeneration is repeated, toner which remains behind due to not having been removed accumulates on the image-retaining medium, which deteriorates the quality of the base material (paper). In addition, it takes many calories to dry paper wet by an aqueous solution. The above method is therefore accompanied by such problems as increased energy consumption, which increases operating costs. In a color image, as opposed to a monotone image, a larger amount of toner is used over the entire image-retaining medium, preventing the surfactant from penetrating the image-retaining medium. As a result, the surfactant, which fails to effect the release of toner and prevents the image-retaining medium from being recycled. When a color image is formed again on the image-retaining medium on which toner remains, it presumably appears as a change in the reproduction of shades.

Disclosed in JP-A Nos. 1-101576 and 1-101577 is a process in which an image-receiving medium is coated with or immersed in a soluble solvent to dissolve and remove toner resin. Disclosed in JP-A No. 4-300395 is a process in which a solvent is adhered to the image-receiving medium by immersion, spraying, or coating to dissolve the toner and the toner thus dissolved is removed by washing, suction, or adsorption, whereby the image-receiving medium is recycled. With this process, the image-forming material can be removed from the image-receiving medium but is accompanied by drawbacks such as the adverse influence of organic solvent use on the safety and environment, the requirement of much energy to dry the solvent, and the curling of paper after drying. In addition, the above process is accompanied by the problem that toner dissolved in a solvent adheres again to the image-receiving medium, preventing the image-retaining medium from maintaining sufficient quality after recycling. In any case, much energy is required to dry the releasing agent used for removing or erasing the image-forming material using a wet system. Furthermore, additives contained in the releasing agent such as surfactant are, when used repeatedly, accumulated in the image-retaining medium and may exert adverse effects on repeated image formation.

Proposed in JP-A Nos. 1-297294 and 4-67043 is a process which comprises applying a silicone sealing material or the like thinly to coat paper, drying the resulting paper to obtain paper (erasable paper) having a surface imparted with releasability, printing on the resulting paper, covering the printing with a hot-fusing material (cleaning material) under a hot-fusing condition for cleaning, cooling the paper, and then removing characters or images, printed together with the hot-fusing material, from the paper. This process is accompanied by drawbacks such as, due to insufficient adhesion between the image-forming material and the releasing agent, the releasing agent transfers from the image-receiving medium to another medium, such as a transfer roller, thereby adversely affecting subsequent image formation, or the transfer of the releasing agent changes the releasability of the image-receiving medium, thereby preventing repeated use. In general, although, with an image-receiving medium having a surface imparted with releasability, it is easy to remove the image-forming material from the base material, it involves the problem of releasing treatment deteriorating the fixability to the base material or transport property of the base material.

Disclosed in JP-A No. 6-219068 is a process in which thermal-transfer recording paper is coated or impregnated with a thermally modified material, for example, a fluorine containing acrylate material, which deteriorates in adhesion with an image-forming material when heated, whereby a recording medium which can be recycled is prepared. This process also involves drawbacks essentially similar to those of the above-described process in which the image-receiving medium has a surface imparted with releasability. In order to ensure the transport property of the recording medium, it is necessary to secure a release-treatment-free portion by sealing both edges of the receiving medium in advance.

In the above-described process for forming a releasable material on the image-receiving medium, the releasing material is formed on the medium by dissolving the releasable material in an organic solvent or the like, and then coating or impregnating the base material with the resulting solution. In other words, the releasable material is formed over the entire receiving medium, which brings about problems in the travel property or transport property of the receiving medium within the image-forming apparatus. Moreover, the above process involves problems in the quality of writing and correction because the releasable material is present even in the image-free portion. Furthermore, the releasing material is generally expensive. A method of coating or impregnating a base material with the releasable material requires a large amount of releasing material and, in addition, the releasing material has an uneconomical aspect which leads to a rise in cost.

In addition, a conventionally proposed process incorporates a releasing agent in an image-forming material in order to prevent offset in fixation by a heated roller. JP-A Nos. 58-215659 and 60-217366, for example, disclose a process in which a wax such as low-molecular-weight polyolefin is added as a releasing agent to an image-forming material. In the above official gazettes, the releasing agent is used to prevent offset, and the amount of releasing agent used is from 0.1 to 20 wt %. Generally, the amount of releasing agent is up to 5 wt % for the above purpose. If the amount exceeds the above range, marked deterioration can be expected to appear in the manufacturability of an image-forming material and powder fluidity because of the existence of the wax on the image-forming material, the image-forming material cannot be uniformly electrically charged and a defective image is formed. Moreover, such an amount may contaminate the carriers or photoreceptor.

A binding resin containing a releasable material is prepared, for example, by kneading, pulverization, and dispersion. During the pulverization step, pulverization occurs at the interface between the binding resin and the releasing agent which have been kneaded so that the image-forming forming material contains much of the releasing agent on its surface. Alternatively, there is a process comprising dispersion of an oil phase containing an image-forming material in an aqueous medium and then granulating the dispersion as, for example, the suspension polymerization process described in Japanese Patent Application Publication (JP-B) No. 36-10231 and the process described in JP-B No. 61-28688. In the suspension polymerization process, an image-forming material having a desired particle size is obtained by dissolving or dispersing raw materials such as a polymerizable monomer, colorant, and releasing agent to prepare a monomer composition and, while carrying out polymerization, using a proper stirring material to disperse the monomer composition in an aqueous phase containing a dispersion stabilizer.

Disclosed in JP-B No. 61-28688 is a process in which an image-forming material is dissolved or dispersed in an organic solvent which is almost insoluble in water, the resulting oil phase is dispersed in an aqueous phase containing a dispersion stabilizer, and then image-forming particles are formed by removing the solvent from the dispersion. Alternatively, it is also possible to prepare an image-forming material by adding a new monomer to an oil phase, which has been subjected to dispersion stabilization, causing a polymerization reaction at the interface of the oil phase, and then encapsulating the polymer. The formation of image-forming particles through a polymerization process such as suspension polymerization requires a purification step to remove the monomer from the polymer composition by solvent extraction or the like, because the polymerization reaction cannot be allowed to proceed to completion, and a problem remains about the safety of such materials. Solvent extraction, however, is accompanied by the problem that the releasing agent and other additives necessary for the image-forming material are extracted together with the monomer.

SUMMARY OF THE INVENTION

An object of the present invention is to overcome the above-described problems found in the conventional technique.

Described specifically, a first object of the present invention is to provide an image-forming material which can be easily removed from image-receiving paper without damaging the paper surface, while maintaining the good fixability of the material to the image-receiving paper.

A second object of the present invention is to provide an image-forming material which makes an image-receiving medium easier to recycle by an image-forming apparatus adopting an electrophotographic system or thermal transfer system even when both monotone and color images are printed solid over the entire surface of the image-receiving medium.

A third object of the present invention is to provide an image-forming material which contains a releasable material free of transfer to media other than the image-receiving medium and therefore overcome the problem related to paper passage through an apparatus.

A fourth object of the present invention is to provide a process for the preparation of the above-described image-forming material, which enables the image-forming material to unfailingly be prepared with ease.

A fifth aspect of the present invention is to provided an image-receiving medium which has been formed by the above-described image-forming material, permits easy recycling, and does not differ greatly from plain paper.

To achieve the above-described objects, the image-forming material according to the present invention features an image-forming material containing at least a binding resin and a releasing agent, and the amount of releasing agent used is 30 to 90 wt % in solid content. It is preferable that the releasing agent be encapsulated in the image-forming material and, moreover, it is preferable that it be composed of a hydrophobic resin and/or a wax.

To achieve the above-described objects, the preparation process of the image-forming material according to the present invention is characterized that an image-forming material, comprising 30 to 90 wt % of a releasing agent in total solid content, prepared by dispersing an oil phase comprising an organic solvent, a binding resin, and a releasing agent in an aqueous phase as oil droplets to form a dispersion; removing the solvent from the dispersion; and then separating the residue and the aqueous phase. Moreover, to achieve the above-described objects, the image-receiving medium of the present invention has a film or image formed over the entire surface or necessary region of the base material by the above-described image-forming material.

In the image-forming material according to the present invention, the amount of releasing agent is 30% to 90 wt % based on total solid content such as a binding resin in the image-forming material. By using the image-forming material of the present invention, a film is formed as needed over the entire surface or necessary region (for example, the image region) of the base material for image formation such as plain recording paper, coated paper, or polyethylene film used for OHP transparencies.

When a film is formed on the image-receiving medium, the receiving medium can be recycled without impairing the quality of writing or correction on the receiving medium. The image-forming material has both fixability and releasability enabling recycling to be carried out easily even if a color image, not only a monotone image, to be printed solid over the entire surface.

Depending on the process for preparing the image-forming material of the present invention, an image-forming material can be obtained that has a particulate-releasing agent substantially encapsulated therein, which makes it possible to prevent the impairment of manufacturability, powder fluidity, and uniform electrical charge; the generation of defective images; and carrier contamination which may otherwise occur by the addition of a large amount of releasing agent to the image-forming material. It is also possible to incorporate the releasing agent in the binding resin and then cover the surface of the binding resin with a thin polymer film formed by interfacial polymerization or graft polymerization.

When a film is formed by the image-forming material over all or only necessary portions (image portions) of the image-receiving medium, both fixability and releasability of the image-forming material can be enabled simultaneously, which makes it possible to recycle the image-receiving medium easily, to transfer the medium smoothly, and to let the medium (paper) be transported easily. In addition, without using a releasing agent composed of water or an organic solvent and a surfactant not suited for use in the office or home, the present invention makes it possible to recycle an image-receiving medium completely in a dry system, and high energy saving can be achieved.

According to the preparation process of the image-forming material of the present invention, in particular, the image-forming material can be obtained with a large amount of a releasing agent incorporated therein. The releasing agent does not exist on the surface of the image-forming material, thus preventing the manufacturability or powder fluidity of the image-forming material from deteriorating and enabling even charging of the image-forming material and thereby avoiding defective images.

The image-receiving medium according to the present invention makes it possible both to do away with the problem of preparing a special image-receiving medium in advance and using paper as is as a receiving medium and to regenerate the image-receiving medium at the site when the receiving medium must be recycled, by adding, to an image recorder, an apparatus for printing releasing-agent-containing image-forming powders or the transfer film of the present invention. Moreover, unlike the conventional image-receiving medium which requires recycling treatment for over its entire surface, including unprinted portions, it is necessary in the present invention only to treat the necessary portion of the image-receiving medium, which makes it possible to improve convenience and minimize the use of expensive materials such as a releasing agent.

Once recycled, the image-receiving medium can be printed or recycled repeatedly. The present invention also makes it possible to provide, without impairing the appearance of plain paper, an image-receiving medium having both fixability and releasability, which are mutually contrary characteristics which cannot be attained using the conventional medium, by forming a film excellent in releasability from the same type of the material as the image-forming material. According to the present invention, it is also possible to recycle both monotone and color image copies even those printed solid over the entire image surface.

DESCRIPTION OF THE PREFERRED EMBODIMENTS

The present invention will hereinafter be described by the preferred embodiments.

The image-forming material of the present invention comprises at least a binding resin and a releasing agent, and the amount of releasing agent is 30 to 90 wt % based on total solid content. Examples of the binding resin contained in the image-forming material include polystyrene, styrene-propylene copolymers, styrene-butadiene copolymers, styrene-vinyl chloride copolymers, styrene-vinyl acetate copolymers, styrene-acrylate copolymers, styrene-methacrylate copolymers, polyester resins, polyurethane resins, polyamide resins, polyimide resins, epoxy resins, and polycarbonate resins, each ordinarily being used for an image-forming resin.

Examples of the releasing agent used for the image-forming material include fluorine resins; silicone resins; copolymers of a fluorine resin and a silicone resin; copolymers of fluorine resins or silicone resins and an acrylic resin or polyester resin; hydrophobic resins such as polyethylene, polypropylene, polycaprolactone, polybutene, and polybutadiene; and natural waxes such as carnauba wax, beeswax, montan wax, paraffin wax, and microcrystalline wax.

The total solid content of the image-forming material are substantially composed of the binding resin and the releasing agent. A colorant, a tackifier, an antistatic agent, a pigment dispersant, and/or the like can be optionally added. The colorant, tackifier, antistatic agent, and/or pigment dispersant is contained in the image-forming material in trace amounts so that total solid content in the image-forming material is substantially equal to the proportion of the total amount of binding resin and releasing agent in the image-forming material.

When the proportion of releasing agent in total solid content is less than 30 wt %, the image formed on the upper layer of the image-forming particles cannot be removed sufficiently. The proportions exceeding 90 wt %, on the other hand, make it difficult to synthesize the image-forming material, markedly deteriorating image properties such as maintainability or picture quality stability in the image-forming apparatus, and, moreover, deteriorating adhesion with the image-forming medium, decreasing the film-forming capacity for a material forming a releasing layer.

The image-forming material of the present invention, which contains a releasing agent, is formed on a image-receiving medium by using an image-forming apparatus to obtain a film containing the releasing agent on the image-receiving medium. An image is formed on the image-receiving medium comprising the above-mentioned film by using the image-forming apparatus. The image recorded on the medium is transferred to the releasing medium opposite the image-receiving medium by heat or pressure, producing an image-receiving medium which can be recycled. As the image-forming material containing the releasing agent, conventionally used materials can be employed so that adhesion or sticking to the image-receiving medium such as plain recording paper, coated paper, or even OHP transparencies do not deteriorate and therefore fixability and recording on the image-receiving material compare favorably to those on the conventional image-receiving material. Furthermore, by incorporating a predetermined amount of releasing agent, both the releasability of the image formed on the upper layer of the image-forming material is satisfied and the fixability of the image-forming material become sufficient because the releasing agent has good affinity with the image-forming material (toner or transfer ink) and it has a proper degree of unevenness on the surface. The releasing agent can be incorporated or encapsulated in the binding resin by adopting a releasing agent that is more hydrophobic than the binding resin and forming particles by a dispersing machine having a high shear force. In order to heighten the affinity between the binding resin and the releasing agent, a silicone block copolymer or silicone graft copolymer can be added as a dispersion aid for the releasing agent in the formation of particles. An inorganic dispersant such as calcium carbonate or silica or general surfactant can also be added in order to prevent cohesion of particles and sharpen the particle-size distribution in distribution in particle formation.

In such an image-forming material comprising an oil phase composed of a binding resin, a releasing agent, a dispersion aid, and an organic solvent, and an aqueous phase composed of water or an aqueous solution of a dispersion stabilizer, since particles are formed with the releasing agent completely incorporated in the binding resin, which is an oil phase, the releasing agent does not exist substantially on the surface of the image-forming material.

A more specific description will next be made of an image-receiving medium which can be recycled by using the image-forming material of the present invention.

The term "image-receiving medium" as used herein means both the image-receiving medium which will be described later and that having an image formed thereon by the image-forming material.

Examples of the image-receiving medium usable in the present invention include plain recording paper generally used in electrophotographic recording, thermal paper used for thermal recording, coated paper used for high-quality printing, slightly coated paper, and a polyester film or transparent resin such as styrene-acrylic resin used for OHP transparencies or the like.

A solvent to dissolve a binding resin, which constitutes the image-forming material, is used to form a film on the image-receiving medium by using an image-forming material. Organic solvents can be used as the solvent. Specific examples of the solvent include aromatic hydrocarbons such as benzene, toluene and xylene; ketones such as acetone, methyl ethyl ketone, methyl isobutyl ketone and 1-methyl-2-pyrrolidone; ethers such as ethylene glycol monomethyl ether, ethylene glycol monoethyl ether and 1,4-dioxane; halogenated hydrocarbons such as trichloroethylene, chloroform, carbon tetrachloride, propylene dichloride and methylene chloride; acids and esters such as ethyl acetate, propyl acetate, butyl acetate, formic acid, glacial acetic acid, 2-ethoxyethyl acetate, dimethyl glutamate, dimethyl adipate and methyl acetate; and N,N-dimethylformamide and the like. Examples of the dispersion stabilizer include polymeric dispersants such as polyvinyl alcohol and gelatin, and finely divided powder such as calcium carbonate and silica as well as general surfactants. Examples of the general surfactant include anionic surfactants such as carboxylate, sulfonate, sulfate ester salt, phosphate ester salt and phosphonate salt; cationic surfactants such as amine salt, quaternary ammonium salt, benzalkonium salt, benzethonium chloride, pyridinium salt, imidazolium salt, sulfonium salt and polyethylene polyamine salt; amphoteric surfactants such as amino acid, carboxybetaine, sulfobetaine, aminosulfate ester, aminocarboxylate salt and imidazoline derivatives; and non-ionic surfactants such as ether type, ether ester type, ester type, nitrogen-containing type, polyhydric alcohol, amino alcohol and polyethylene glycol. The solvents, dispersion stabilizers, and surfactants are not, however, limited to those exemplified above.

Specifically, examples of the anionic surfactant include salts of carboxylic acid such as fatty acid salts, rosin salts, naphthenate salts, ether carboxylate salts, alkenyl succinate salts, N-acylsarcosine salts, N-acylglutamate salts, monoalkyl sulfate salts, dialkyl sulfate salts, alkylpolyoxyethylene sulfate salts, alkylphenylpolyoxyethylene sulfate salts, monoacylglycerin sulfate salts, acylamino sulfate ester salts, sulfuric acid oils and sulfated fatty acid alkyl esters; salts of sulfonic acid such as α-olefinsulfonate salts, secondary alkanesulfonate salts, α-sulfo fatty acid, acylisethionate salts, N-acryl-N-methyltaurine acid, dialkylsulfosuccinate salts, alkylbenzenesulfonate salts, alkylnaphthalene sulfonate salts, alkyldiphenylether disulfonate salts, petroleum sulfonate salts and ligninsulfonate salts; salts of a phosphate ester such as alkyl phosphate salts and alkylpolyoxyethylene phosphate salts; sulfonic acid-modified or carboxyl-modified silicone-base anionic surfactants; fluorine-base surfactants such as perfluoroalkylcarboxylate salts, perfluoroalkylsulfonate salts, perfluoroalkylphosphate esters, and perfluoroalkyltrimethylammonium salts; and lipid type surfactants, biosurfactants and oligo soaps.

Specific examples of the cationic surfactant include salts of alkyl amine or acyl amine such as primary amine salts, acylaminoethyldiethylamine salts, N-alkylpolyalkylene polyamine salts, fatty acid polyethylene polyamides, amides and salts thereof and amine salts; quaternary ammonium salts or ammonium salts containing an amide bond such as alkyl trimethylammonium salts, dialkyl dimethylammonium salts, alkyl dimethylbenzylammonium salts, alkyl pyridinium salts, acylaminoethyl methyldiethyl ammonium salts, acylaminopropyl dimethylbenzylammonium salts, acylaminopropyl diethylhydroxyethyl ammonium salts, acylaminoethyl pyridinium salts, and diacylaminoethyl ammonium salts; ammonium salts containing an ester or ether bond such as diacyloxyethylmethylhydroxyethyl ammonium salts and alkyloxymethyl pyridinium salts; imidazoline or imidazolium salts such as alkyl imidazolines, 1-hydroxyethyl-2-alkylimidazolines and 1-acylaminoethyl- 2-alkylimidazoliums; and amine derivatives such as alkylpolyoxyethylene amines, N-alkylaminopropylamines, N-alkylpolyethylene polyamines, N-acylpolyethylene polyamines, and fatty acid triethanolamine esters.

Examples of the amphoteric surfactant include sodium laurylaminorpropionate, lauryl dimethyl betaine, stearyl dimethyl betaine, lauryl dihydroxyethyl betaine and lecithin.

Examples of the anionic surfactant include polyoxyethylene adducts such as alkylpolyoxyethylene ethers, alkylpolyoxyethylenes, polyoxypropylene ethers, fatty acid polyoxyethylene esters, fatty acid polyoxyethylene sorbitan esters, fatty acid polyoxyethylene sorbitol esters, polyoxyethylene castor oils, and alkylpolyoxyethylene amines, and amides; polyhydric alcohols and alkylol amides such as fatty acid sorbitan esters, fatty acid polyglycerin esters and fatty acid sucrose esters; silicone-base surfactants such as polyethers-modified, alkylaralkylpolyether-modified, epoxypolyether-modified, alcohol-modified, fluorine-modified, amino-modified, mercapto-modified, epoxy-modified, or allyl-modified silicone-base surfactants; and fluorine-base surfactants such as perfluoroalkylethylene oxide adduct. The above-exemplified surfactants can be used in combination.

As silicon-base polymer such as silicone block or silicone graft polymer to be added as a dispersion aid for a releasing agent, that having the same component as constituting the binding resin to be used or having a component compatible with the binding resin is preferable in consideration of affinity with the binding resin. The silicone-base polymers are each prepared by copolymerization of a monomer, for example, a monomer constituting polystyrene, a styrene-propylene copolymer, a styrene-butadiene copolymer, a styrene-vinyl chloride copolymer, a styrene-vinyl acetate copolymer, a styrene-acrylate copolymer, a styrene-methacrylate copolymer, a polyester resin, a polyurethane resin, a polyamide resin, a polyimide resin, an epoxy resin, or a polycarbonate resin, or a macromer thereof with a reactive silicone compound; or prepared by the reaction such as graft polymerization of such a polymer with a reactive silicone compound.

In order to use the image-forming material of the present invention as an image-forming medium, it is preferable that the image-forming material be white or transparent, because an image is formed on the surface of the film by the image-forming material. It is, however, possible to mix a colorant or the like in the image-forming particles in order to use for discrimination with a plain-paper recording medium or to prevent alteration of the image, or to use as image-forming particles which can be recycled. Examples of the colorant usable here include carbon black, nigrosine, aniline blue, chrome yellow, ultramarine blue, Dupont oil red, quinoline yellow, methylene blue chloride, phthalocyanine blue, malachite green oxalate, lamp black, rose red oxide, C.I. pigment red 48:1, C.I. pigment red 122, C.I. pigment red 57:1, C.I. pigment yellow 97, C.I. pigment yellow 12, C.I. pigment blue 15:1, C.I. pigment blue 15:3, magnetic powder, and titanium oxide. To the above-described image-forming material, a tackifier, antistatic agent, pigment dispersant, and/or oil (mineral oil) may be added.

In the preparation of the image-forming material, oil droplets are dispersed in an aqueous phase containing an oil phase by using a dispersing apparatus or emulsifier such as the disperser, homogenizer, or colloid mill which is known to date.

The image-forming material can be obtained by subjecting, to heat or pressure reduction to remove the organic solvent in the oil phase dispersed in the aqueous phase, thereafter removing the aqueous phase by filtration, washing the solid content obtained as needed, and drying. The image-forming material can be formed into various shapes such as spherical or amorphous, depending on the amount or type of organic solvent, dispersant, or surfactant.

It is preferable, even in principle, that from the image-receiving paper on which the image has been formed, such image-receiving paper having been imparted with releasability of the image-forming material, the image-forming material be removed in accordance with a method similar to the method of forming the image-forming material on the image-receiving medium. In a thermal transfer system or electrophotographic system, for example, images are formed by thermally fixing the image-forming material on paper. The image-forming material is fused by reheating the once-fixed image, which makes removal of the material from the paper easy. Accordingly, if a fixing apparatus in the image-forming apparatus can be used as a releasing apparatus, it is not necessary to prepare a special additional apparatus. The image-forming apparatus also serves as an image-removing apparatus, thereby eliminating space otherwise occupied by the releasing apparatus and therefore the unoccupied space can be used effectively.

The image-receiving medium is eliminated, for example, by installing, instead of a fixer of an electrophotographic apparatus, a pressure roller in the direction opposite a thermal head, installing an image-eliminating apparatus with which heat and pressure can be applied simultaneously, stacking an OHP transparency to be printed upon the image-receiving medium on which a color image or the like has been recorded, allowing the image-eliminating apparatus to pass over the image-receiving medium in accordance with the printing pattern of the image portion to be eliminated while charging the thermal head with electricity, and separating the OHP transparency from the image-receiving medium just after the image-eliminating apparatus has passed, thereby transferring only the desired image to the OHP transparency, which is one of the preferred examples.

It is also possible to remove the image-forming material by using an auxiliary means, for example, by impregnating image-receiving paper with an organic solvent to dissolve the image-forming material or an aqueous solution or organic solvent which contains a surfactant for weakening the linkage between the paper fiber and the image-forming material. Together with such means, physical action such as ultrasonic vibration can be applied in the removal of the image-forming material.

EXAMPLES

The present invention will hereinafter be described more specifically using examples. It should not be construed, however that the present invention is limited to such examples. Incidentally, all designations of "part" in examples and comparative examples indicate "part(s) by weight".

Example 1

Preparation of a Dispersion of a Releasing Agent 30 parts of polyethylene wax (trade name Mitsui High Wax 2203A; manufactured by Mitsui Petrochemical Industry Co., Ltd.) were added to 70 parts of ethyl acetate. The resulting mixture was put in a pressure container equipped with an agitator, heated to 100° C., and stirred using a high shear force. The reaction mixture was then quenched, thereby preparing a dispersion of a releasing agent. The resulting dispersion had an average particle size of 0.5 μm and the maximum particle size of about 2 μm.

The dispersion (30 parts) of the releasing agent thus obtained, 21 parts of a polyester resin A (Tm=100° C., Tg=63° C.) synthesized by copolymerization between a propylene oxide adduct of bisphenol A and a terephthalic acid derivative, and 1.5 parts of ethyl acetate were mixed under stirring, to prepare an oil phase. A 2.5% aqueous solution (100 parts) of carboxymethyl cellulose sodium (trade name Cellogen BS-H; manufactured by Dai-ichi Kogyo Seiyaku Co., Ltd.) was provided as an aqueous phase. Calcium carbonate (trade name Ruminas; manufactured by Maruo Calcium Co., Ltd.) was added to the aqueous phase as a dispersion stabilizer to yield an amount of 10%. The oil phase was added to the water phase, followed by stirring, whereby the resulting mixture was finely divided. The solvent was then removed from the oil phase by heating. The residue was washed sufficiently with an aqueous solution of hydrochloric acid and water, followed by filtration and drying, to yield releasing-agent-containing image-forming particles having an average particle size of 7.6 μm. The releasing agent (polyethylene wax) in the image- forming particles thus obtained was 30 wt % based on solid content.

The image-forming particles thus obtained were mixed with 1% of silica (trade name R972; manufactured by Nippon Aerosil Co., Ltd.) and the mixture was used to form a solid image on A4 size paper J for Xerox (manufactured by Fuji Xerox Co., Ltd.) using A Color 635 (manufactured by Fuji Xerox Co., Ltd.), which was provided as a regeneratable image-receiving medium. On the image-receiving medium so obtained, a color image including characters and solid image was fixed using A Color 635.

The fixability of the image-forming material was evaluated as follows: A commercially available cellophane adhesive tape 18 mm wide (trade mark Cellotape; manufactured by Nichiban Co., Ltd.) was adhered at a linear pressure of 300 g/cm to a solid image portion having a density of about 1.8 as measured by an X-Rite 938 densiometer (manufactured by X-Rite Corp.), this solid image portion having been fixed by the above-described electrophotographic apparatus, and then the tape was peeled off at a speed of 10 mm/sec. Evaluation was made using the ratio of the image density after release to the image density before release (hereinafter, OD ratio) as an index (OD ratio: image density after release/image density before release). For the electrophotographic image-receiving medium, the image-forming material is required to have a fixability of 0.8 or more as an OD ratio.

Upon recycling of the image-receiving medium, the heat roller having a silicone rubber surface layer was replaced by a heat roller having a surface on which an aluminum anodized film had been applied in the fixer of the above-described electrophotographic apparatus, and a metallic blade was provided in order to scrape off the image-forming particles released from the paper onto the heat roller. The image-forming particles can be removed only by allowing the image-receiving medium, on which an image had been recorded, to pass through the fixer of the above apparatus, whereby image-recorded paper was recycled. The amount of the image-forming particles remaining on the regenerated paper after removal (after release) was evaluated, in a manner similar to the evaluation of the fixability of the image-forming particles, with an OD ratio as an index. As a negligible image density, an OD ratio of 0.08 or more is preferred. Moreover, repeated stability was confirmed by rating the fixability of the image-forming particles and the remaining amount of them on the recycled paper after removal (after release) when image recording and image removal on the paper were each repeated 10 times. The results of Example 1 and examples described hereinafter as well as comparative examples described hereinafter are summarized in Table 1.

Comparative Example 1

Image-forming materials were prepared in a manner similar to Example 1 except that the amount of polyethylene wax was reduced to 10 parts and that of the polyester resin A was raised to 90 parts. The amount of the releasing agent (polyethylene wax) in the image-forming particles was 10 wt % based on total solid content.

Using the image-forming particles so obtained, a solid image was formed in a manner similar to Example 1 on Xerox paper. A color image including characters and a solid image was fixed onto that image-receiving medium by using A Color 635, then, the fixability and releasability of the image on the image-receiving medium were evaluated in a manner similar to Example 1.

Example 2

Synthesis of a Silicone Dispersion Aid 73.2 g (0.3 mol) of dimethyl 2,6-naphthalene dicarboxylate, 135.8 g (0.7 mol) of dimethyl terephthalate, 206.4 g (0.6 mol) of 2,2-di(4-hydroxypropoxyphenyl) propane, 124.0 g (2.0 mol) of ethylene glycol, 0.27 g (0.8 mmol) of tetrabutyl titanate, and 111.4 g (0.2 mol) of epoxy-containing dimethyl polysiloxane represented by formula I, which will be described below, were put in a 1-liter flask manufactured from glass and equipped with an agitator, thermometer, condenser, ester adapter, and pressure-reducing device. They were heated by a mantle heater under a nitrogen gas stream, followed by a methanol removal reaction at 160 to 170° C. for 6 hours. At that time, methanol distilled by the ester adapter was 62.1 g.

(I)

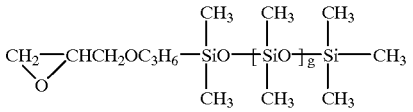

Over a 1-hour interval, the residue was heated to 220° C., followed by ethylene glycol removal reaction at 220 to 240° C. under reduced pressure of 20 mmHg for 3 hours. The ethylene glycol distilled was 71.2 g. After completion of the reaction, the polymer thus obtained was cooled to room temperature, to yield 386.9 g of a pale brown, semitransparent solid. The weight-average molecular weight as measured by GPC was 20,000 for polystyrene, the glass transition point as measured by a differential thermal analyzer (DSC) was 66° C. and the softening point as measured by the ring-and-ball method was 115° C. The hydroxyl value (JIS-K 0070) was 25.7 mg KOH/g. The corresponding monomers were polyhydric carboxylic acid having the molar ratio shown in formula II below and polyhydric alcohol having the molar ratio shown in formula III below. As a result of a quantitative analysis of dimethyl polysiloxane by atomic absorption spectroscopy, the polymer thus yielded contained 19.9 wt % of dimethyl siloxane.

(II)

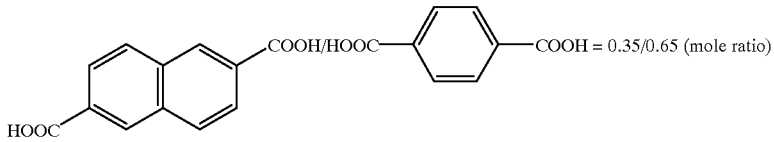

(III)

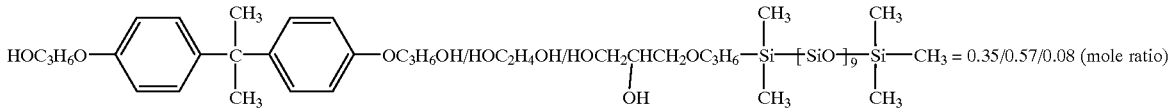

Mixed under stirring were 60 parts of a copolymer (trade name FX-3330; manufactured by Sumitomo 3M Limited; an ethyl acetate solution having a solid content of 30%) between a fluorine resin and an acrylic resin, 18 parts of polyester resin B (Tg=66° C., Tm=105° C.) which is a polyester resin composed of a propylene oxide adduct of bisphenol A, an ethylene oxide adduct of bisphenol A, and a succinic acid derivative; 1.8 g of the above-described silicone dispersion aid; 0.9 parts of silyl isocyanate (Orgatics SI-310; manufactured by Matsumoto Seiyaku) and 3 parts of a 3:1 mol adduct of xylene diisocyanate and trimethylol propane (trade name Takenate D-110N; manufactured by Takeda Chemical Industries, Ltd.), whereby an oil phase was prepared. A 2.5% aqueous solution of carboxymethyl cellulose sodium (trade name Cellogen BS-H; manufactured by Dai-ichi Kogyo Seiyaku Co., Ltd.) (120 parts) were provided as an aqueous phase. The oil phase was poured in the aqueous phase, followed by emulsion dispersion. The dispersion was then finely divided. The solvent was then removed from the oil phase by heating, followed by filtration and drying, whereby releasing-agent-containing image-forming particles having an average particle size of 7.8 μm were obtained. The amount of the releasing agent (copolymer of a fluorine resin and an acrylic resin) in the image-forming material was 50 wt % based on total solid content.

In a manner similar to Example 1, a solid image was formed on Xerox paper by using the image-forming particles so obtained. Onto that image-receiving medium, a color image including characters and a solid image was fixed by A Color 635. The fixability and releasability of the image on the image-receiving medium were evaluated in a manner similar to Example 1.

Example 3

Image-forming particles were prepared in a manner similar to Example 2 except that 50 parts of the silicone resin (trade name XC99-A5263; manufactured by Toshiba Silicone Co., Ltd.; an ethyl acetate solution having a solid content of 30 wt %), 15 parts of the polyester resin B and 1.5 g of the above silicone dispersion aid were used instead. The amount of the releasing agent (silicone resin) in the image-forming material was 50 wt % based on total content.

In a manner similar to Example 1, the image-receiving medium was obtained by covering the entire surface with the image-forming particles so obtained. On the resulting image-receiving medium, an image was recorded as done in Example 1 and the fixability and releasability were evaluated.

Comparative Example 2

Preparation of image-forming particles was attempted in a manner similar to Example 3 except that 100 parts of the silicone resin (trade name XC99-A5263; manufactured by Toshiba Silicone Co., Ltd.) were used and the polyester resin was not used. It was not, however, possible to form (emulsify) particles in the solution when the image-forming material was composed only of the releasable material. As a result, no image-forming particles were prepared.

Example 4

Mixed under stirring were 41.7 parts of a copolymer (trade name FX-3330; manufactured by Sumitomo 3M Limited; an ethyl acetate solution having a solid content of 30%) between a fluorine resin and an acrylic resin and 12.5 parts of polyester resin A (Tm=100° C., Tg=63° C.) used in Example 1, whereby an oil phase was prepared. A 2.5% aqueous solution of carboxymethyl cellulose sodium (trade name Cellogen BS-H; manufactured by Dai-ichi Kogyo Seiyaku Co., Ltd.) (100 parts) was provided as an aqueous phase. Calcium carbonate (trade name Ruminas; manufactured by Maruo Calcium Co., Ltd.) was added to the aqueous phase to yield an amount of 20%. After the addition of the oil phase to the aqueous phase, the resulting mixture was stirred to form particles. The solvent was then removed from the oil phase by heating. The residue was washed sufficiently with an aqueous solution of hydrochloric acid and water, followed by filtration and drying, whereby releasing-agent-containing image-forming particles having an average particle size of 8.4 μm were prepared. The releasing agent (a copolymer of a fluorine resin and an acrylic resin) in the image-forming material was 50 wt % based on total solid content.

The image-receiving medium was obtained by covering the entire surface with the image-forming particles so obtained in a manner similar to Example 1. On the resulting image-receiving medium, an image was recorded as done in Example 1 and the fixability and releasability were evaluated.

Example 5

Image-forming particles having an average particle size of 7.8 μm were prepared in a manner similar to Example 4 except that a silicone resin (trade name XR59-B0859; manufactured by Toshiba Silicone; an ethyl acetate solution having a solid content of 50 wt %) was used instead of the copolymer (FX-3330) of a fluorine resin and an acrylic resin; and a surfactant (trade name Nonipol 95; manufactured by Kao Corporation) was added to the aqueous phase to yield an amount of 1%. The releasing agent (copolymer between a fluorine resin and an acrylic resin) in the image-forming material was 50 wt % based on total solid content.

In a manner similar to Example 1, the image-receiving medium was obtained by covering the entire surface with the image-forming particles so obtained. An image was recorded on the resulting image-receiving medium as done in Example 1 and the fixability and releasability were evaluated.

Example 6

Image-forming particles having an average particle size of 7.2 μm were prepared in a manner similar to Example 5 except for the use of polycaprolactone (trade name Plaqcel H5; manufactured by Daicel Chemical Industries, Ltd., a butyl acetate solution having a solid content of 30 wt %) instead of the silicone resin. The amount of the releasing agent (caprolactone) in the image-forming material was 50 wt % based on total solid content.

In a manner similar to Example 1, the image-receiving medium was obtained by covering the entire surface with the image-forming particles so obtained. On the resulting image-receiving medium, an image was recorded as done in Example 1 and the fixability and releasability were evaluated.

Example 7

The image-forming material of Example 5 was diluted with tetrahydrofuran (THF) to give a solid concentration of 10%. The diluted material was wire-bar-coated onto a polyester film, followed by drying at 100° C., whereby a transfer film having an ink layer about 3 μm thick in which a releasable material had been incorporated was formed. The transfer film so obtained was set on a thermal transfer apparatus (trade name FNP-300; manufactured by Matsushita Electric Industrial Co., Ltd.), followed by printing a solid image on the entire surface of paper J of A-4 size for Xerox, which was provided as an image-receiving medium which could be recycled. A color image including characters and a solid image was fixed on the resulting image-receiving medium by using A Color 635.

The fixability and releasability of the image-forming material were evaluated as done in Example 1.

Example 8

A monotone image was printed on the image-receiving medium obtained in Example 7 using a thermal transfer apparatus (trade name FNP-300; manufactured by Matsushita Electric Industrial Co., Ltd.).

The fixability and releasability of the image-forming material were evaluated as done in Example 1.

Example 9

A color image including characters and a solid image was fixed onto the image-receiving medium obtained in Example 5 using A Color 635. The fixability was evaluated as shown in Example 1. Upon recycling of the image-receiving medium, instead of a fixer of the electrophotographic apparatus of Example 1, an image-eliminating apparatus equipped with a pressure roller in the direction opposite the thermal head and capable of simultaneously applying heat and pressure was installed. Then a surface of A Color OHP transparency to be printed was stacked upon the image-receiving medium on which a color image and the like had been recorded. In accordance with the printing pattern of the image portion to be eliminated, the image-eliminating apparatus was allowed to pass over the image-receiving medium while charging the thermal head with electricity. The image-receiving medium and the OHP transparency were separated from each other just after the image-eliminating apparatus had passed, whereby only the desired image was transferred to the OHP transparency and thus the image was eliminated. Incidentally, the releasability of the image was evaluated as done in Example 1.

TABLE 1

| | Releasing agent | Initial stage | | 10 regenerations | |
|---|---|---|---|---|---|
| Example | based on solid content (wt %) | Fixability | After release (OD ratio) | Fixability | After release |
| 1 | 30 | 0.97 | 0.05 | 0.90 | 0.07 |
| CE 1 | 10 | 0.98 | 0.35 | 0.85 | 0.45 |
| 2 | 50 | 0.98 | 0.02 | 0.95 | 0.04 |
| 3 | 50 | 0.97 | 0.03 | 0.95 | 0.05 |
| 4 | 50 | 0.98 | 0.03 | 0.95 | 0.06 |
| 5 | 50 | 0.96 | 0.02 | 0.95 | 0.03 |
| 6 | 50 | 0.94 | 0.07 | 0.90 | 0.07 |
| 7 | 50 | 0.90 | 0.07 | 0.88 | 0.09 |
| 8 | 50 | 0.91 | 0.02 | 0.94 | 0.03 |
| 9 | 50 | 0.92 | 0.08 | 0.89 | 0.09 |
| CE 2 | 100 | Image-forming particles not preparable | | | |

CE: Comparative example

What is claimed is:

1. An image-forming material applied to an image-receiving medium and forming an image, the image forming material comprising at least a binding resin and a releasing agent, said releasing agent being contained in a solid content in an amount of 30 to 90 wt. % the image-receiving medium being selected from the group consisting of plain recording paper, thermal paper, slightly coated paper, and a polyester film or transparent resin used for OHP transparencies, and the image-forming material being removable from the image-receiving medium.

2. An image-forming material according to claim 1, wherein said image-forming material is composed of image-forming particles.

3. An image-forming material according to claim 1, wherein said releasing agent is substantially encapsulated in said image-forming material.

4. An image-forming material according to claim 1, wherein said releasing agent is composed of a hydrophobic resin and/or a wax.

5. An image-forming material according to claim 4, wherein said hydrophobic resin is at least one resin selected from the group consisting of fluorine resins, silicone resins, copolymers of fluorine resins and silicone resins, copolymers of fluorine resins or silicone resins and acrylic resins or polyester resins, polyethylene, polypropylene, polycaprolactone, polybutene, and polybutadiene.

6. An image-forming material according to claim 4, wherein said wax is at least one wax selected from the group consisting of natural waxes such as carnauba wax, beeswax, montan wax, paraffin wax, and microcrystalline wax.

7. A process for the preparation of an image-forming material as claimed in claim 1, which comprises the steps of: dispersing an oil phase which comprises an organic solvent, a binding resin, and a releasing agent in an aqueous phase as oil droplets to form a dispersion; removing the solvent from the dispersion; and then separating the residue from the aqueous phase, to obtain said image-forming material.

8. A process for the preparation of an image-forming material according to claim 7, wherein the image-forming material is composed of image-forming particles.

9. A process for the preparation of an image-forming material according to claim 7, wherein the dispersing step causes said releasing agent to be substantially encapsulated in the image-forming material.

10. A process for the preparation of an image-forming material according to claim 7, wherein said releasing agent is composed of a hydrophobic resin and/or a wax.

11. A process for the preparation of an image-forming material according to claim 10, wherein said hydrophobic resin is at least one resin selected from the group consisting of a fluorine resin, a silicone resin, a copolymer of a fluorine resin, and a silicone resin; a copolymer of a fluorine resin, silicone resin, and an acrylic resin, or a polyester resin; polyethylene, polypropylene, polycaprolactone, polybutene, and polybutadiene.

12. A process for the preparation of an image-forming material according to claim 10, wherein said wax is at least one wax selected from natural waxes such as carnauba wax, beeswax, montan wax, paraffin wax, and microcrystalline wax.

13. An image-receiving medium, which comprises a base material and a film which has been formed on the entire or required portion of the base material by the image-forming material as claimed in claim 1.

14. An image-receiving medium, comprising a base material and an image formed on the base material by the image-forming material as according to claim 1.

15.A method of forming an image on an image-receiving medium, comprising:

providing an image-receiving medium selected from the group consisting of plain recording paper, thermal paper, slightly coated paper, and a polyester film or transparent resin used for OHP transparencies; and applying an image-forming material on the image-receiving medium to form an image, the image forming material comprising at least a binding resin and a releasing agent, said releasing agent being contained in a solid content in an amount of 30 to 90 wt. %, and the image-forming material being removable from the image-receiving medium.

16. The method according to claim 15, wherein the image is a color image.

17. The method according to claim 15, further comprising:

removing the image-forming material from the image-receiving medium; and applying the image-forming material on the image-receiving medium to form another image.

18. The method according to claim 15, wherein the image-forming material is applied over only an image portion of the image-receiving medium.

19. The method according to claim 18, further comprising:

removing the image-forming material from the image portion of the image-receiving medium; and applying the image-forming material on the image portion of the image-receiving medium to form another image.

20. The method according to claim 18, wherein the image is a color image.

* * * * *